US005392785A

United States Patent [19]

Donahue

[11] Patent Number: 5,392,785

[45] Date of Patent: Feb. 28, 1995

[54] SUPPORT FOR SIDE-LYING PREMATURE INFANTS

[76] Inventor: Deborah Donahue, 16 Kenyon St., West Newton, Mass. 02165

[21] Appl. No.: 831,184

[22] Filed: Feb. 5, 1992

[51] Int. Cl.[6] ..... A61B 19/00; A61F 5/37

[52] U.S. Cl. ..... 128/869; 128/873

[58] Field of Search ..... 128/869, 872, 873, 874; 441/108, 129, 131; 2/69, 69.5, 70, 75, 78, 79, 80; 5/93 R, 655, 431, 424, 432, 652, 436, 630, 446, 922

[56] References Cited

U.S. PATENT DOCUMENTS

| | | | |
|---|---|---|---|
| 2,481,741 | 9/1949 | Graves | 128/873 |
| 3,315,671 | 4/1967 | Creelman . | |
| 3,848,281 | 11/1974 | Mathews . | |
| 3,902,456 | 9/1975 | David . | |
| 4,125,903 | 11/1978 | Farrell | 2/69.5 |
| 4,173,048 | 11/1979 | Varaney . | |
| 4,223,670 | 9/1980 | Cramer . | |
| 4,451,932 | 6/1984 | Wagemann | 2/80 |
| 4,655,207 | 4/1987 | Ellis . | |
| 4,759,082 | 7/1988 | Mulligan | 2/75 |
| 4,802,244 | 2/1989 | McGrath-Saleh | 2/69.5 |
| 4,894,878 | 1/1990 | Roach | 2/69.5 |
| 4,897,885 | 2/1990 | Lunt | 2/69.5 |
| 4,980,937 | 1/1991 | Mason et al. . | |
| 4,989,282 | 2/1991 | Goldstein | 2/69.5 |
| 5,007,413 | 4/1991 | Thune . | |
| 5,046,204 | 9/1991 | Mohler | 2/69.5 |
| 5,062,168 | 11/1991 | Kocib | 2/69.5 |

OTHER PUBLICATIONS

"Humans Reach Where the Machines Can't", *Boston Globe*, pp. 29 and 33 (Apr. 23, 1991).

Als et al., *Pediatrics* 78(6):1123–1132 (1986).

Als in the High-Risk Neonate: Developmental Therapy Perspectives. *Physical and Occupational Therapy in Pediatrics* 6(3/4):3–55 (1986).

*Primary Examiner*—Michael A. Brown

*Attorney, Agent, or Firm*—Fish & Richardson

[57] ABSTRACT

A device sized and shaped to comfortably restrain and support a premature infant on his side. The device has a toroidal perimeter wall defining a central cavity, open at the top and bottom and sized and shaped to enclose the infant in side-lying position. The wall has a head-support portion sized to support the infant's head and neck, a foot-brace portion spaced from the head-support portion, and a back-support portion connecting the foot-brace portion and the head-support portion. The back-support portion is curved to support the infant's spine, and it is sized to maintain a spacing between the head-support portion and the foot-brace portion less than the infant's length. Therefore, the sidelying infant's feet are braced or supported by the foot-brace portion with his hips and knees flexed, with his spine and neck curved, and with his head supported by the head-support portion.

7 Claims, 1 Drawing Sheet

SUPPORT FOR SIDE-LYING PREMATURE INFANTS

BACKGROUND OF THE INVENTION

This invention is in the general field of infant care apparatus, specifically, apparatus used in the care of premature neonates.

Medical advances have made it possible to save the lives of increasing numbers of infants who are born prematurely. The term "premature" is generally applied to babies born prior to about 37 weeks of gestation, and, increasingly, infants who are far more premature than that survive. Premature infants may require substantial periods of treatment in hospital intensive care facilities. Such treatment may involve constant monitoring of vital signs and frequent interventions including withdrawing blood samples or other fluids and administering therapeutics. Devices for administering medications and monitoring the infant's condition may restrict movement and be invasive.

Premature infants will exhibit a variety of body responses when exposed to medical procedures and equipment. Due to their immaturity, they often lack the neurological development and organization necessary to regulate their behavior, for example to reorganize themselves and calm themselves after exposure to stressful stimuli. The result can be an inconsolable infant or physical exhaustion, and both of these consequences can be detrimental to the infant's medical condition.

Premature infants are often positioned lying on their abdomens because it is easier to provide constraint, i.e., the infant will temporarily calm his behavior in this position. Also it is easier to care for the infant in this position. However, if consistently used, this abdominal position can result in body misalignments. Less frequently, infants are put in a side lying position, but in that unrestrained position infants are less able to calm themselves.

SUMMARY OF THE INVENTION

I have discovered a device which comfortably restrains and supports premature infants in a side-lying position. The device tolerates the infant's own attempts to self regulate his behavior and, ultimately, it can reduce or prevent detrimental bodily changes associated with stress.

In general the invention features a toroidal perimeter wall defining a central cavity, open at the top and bottom and sized and shaped to enclose the infant in side-lying position. The wall has a head-support portion sized to support the infant's head and neck, a foot-brace portion spaced from the head-support portion, and a back-support portion connecting the foot-brace portion and the head-support portion. The back-support portion is curved to support the infant's spine, and it is sized to maintain a spacing between the head-support portion and the foot-brace portion which is somewhat less than the infant's length. Therefore, the side-lying infant's feet are supported by the foot-brace portion with his hips and knees partially flexed, with his spine and neck curved, and with his head supported by the head-support portion.

In preferred embodiments, the foot-brace portion of the wall is higher than the head-support portion of the wall to provide a strong brace against the feet. Also preferably, the head-support portion of the wall is removable; the wall includes at least one closure attaching the head-support portion of the wall to the back-support portion of the wall. Most preferably, the closure includes an adjustment member for changing the spacing between the head-support portion and the foot-brace portion.

The invention thus provides consistent gentle support to maintain the infant in a side-lying posture which encourages self-regulating behavior to assist the infant to maintain control and, if control is lost, to provide clues and support that enables the infant to regain control more quickly. Specifically, the support provided by the invention avoids uncontrolled disorganized movements, and permits limited movements that provide neurological feedback which encourages self-regulation.

Other features and advantages of the invention will be apparent from the following description of the preferred embodiment (including the drawings thereof) and from the claims.

DESCRIPTION OF THE PREFERRED EMBODIMENT

Figure 1:
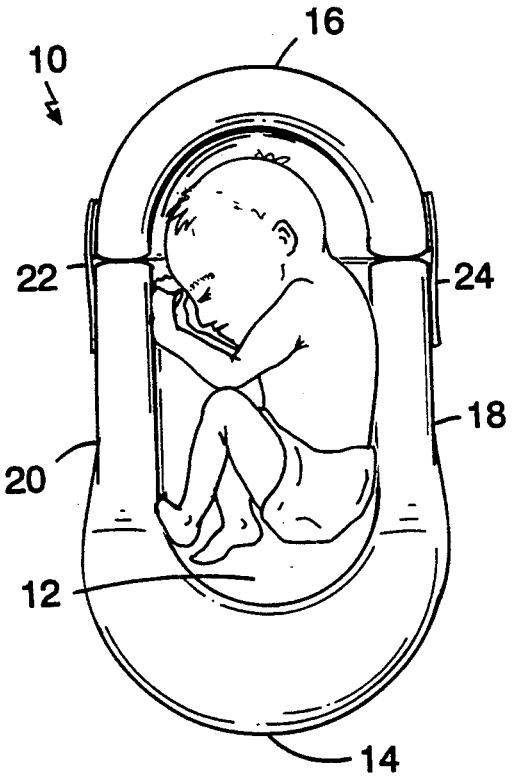
FIG. 1 is a top view of a device according to the invention, in use.
Figure 2:
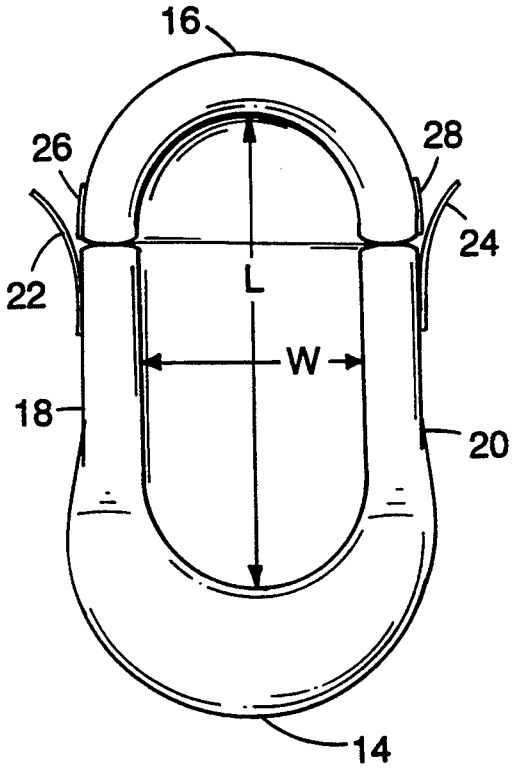
FIG. 2 is a side view of the device of FIG. 1.
Figure 3:
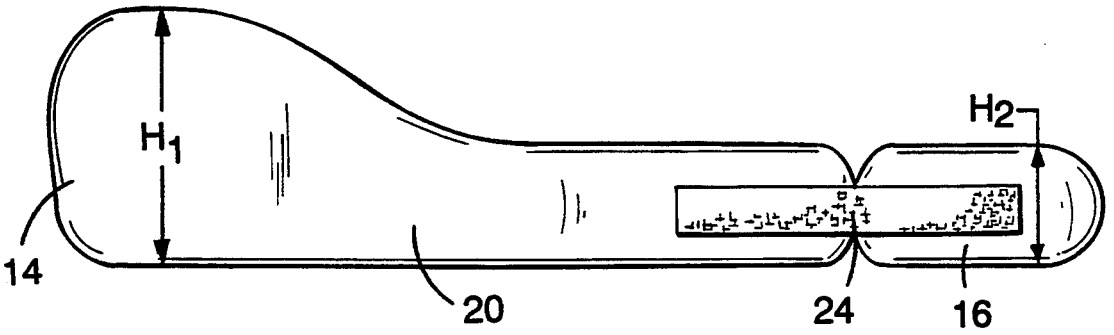
FIG. 3 is a top view of the device of FIG. 1, showing the removable attachment.

In FIGS. 1–3, the toroidally shaped device 10 encloses an infant in side-lying position. Device 10 comprises a wall defining a central cavity 12 that is open at the top and the bottom. The wall is formed from a fabric (e.g. cotton) enclosing padding (e.g. polyester fill), both of which are suitable for use in a medical environment—i.e., they can be initially sterilized; they are relatively inexpensive, permitting disposal after use with a single patient; and they are non-allergenic. The wall is flexible, to permit the device to conform to the patient in side-lying position.

The wall includes different portions as described below. Wall portion 14 is a foot-brace position, suitable for bracing or restraining the infant's feet. Wall portion 16 is a head-support portion sized and configured to gently support the infant's head. Wall portions 18 and 20 connect head-support portion 16 to foot-bracing portion 14, and either is suitable to support the infant's back in sidelying position.

Preferably, foot-brace portion 14 is stronger (e.g., higher) than other portions of the wall to provide a gentle brace against leg extension and hip extension. While it need not be thicker than other portions of the wall, the additional height can, after use cause an apparent wall thickening as the padding shifts. For example, the foot-brace portion may have at least a 2 inches thickness of padding and be about 4–5 inches high.

The head-support portion 16 is removably attached to wall portions 18 and 20 by Velcro ® closures 22/24 which mate with cooperating Velcro ® closures 26/28 (see FIG. 3). The closures are adjusted to fit the infant's contour when his knees and hips are partially flexed, as shown in FIG. 1. In view of the flexibility of the wall, the actual shape and contour of the central cavity will vary.

The dimension of central cavity 12 are important for correct support and positioning. Moreover, the device is designed to allow the central cavity to conform to the infant as he changes position and as he grows. For this reason, the walls of the device are somewhat flexible. It is also important to allow caregivers to have easy access to the infant in a standard isolette. The walls should not be too tall (e.g., preferably less than 5 inches and most preferably less than 4 inches) in the head brace region of the wall and less than 7 inches (more preferably less than 6 inches and most preferably less than 5½ inches) in the foot brace region of the wall. The rigidity and particularly the height of the walls is insufficient to support a sitting infant. Indeed the height of the walls is such that if an infant placed within the enclosure topples over (e.g., the infant lacks well developed sitting skills), the wall could catch the infant below the neck, allowing unrestrained head snap. Thus, the device is not designed to support sitting. Finally, the walls should not be extremely rigid or close together (from head-to-foot) as to cause an infant who is pushing against the foot brace (e.g. in distress) to bend his head so far forward that his airway closes.

The adjustable closures described above permit changes to distance "L" to maintain the desired relationship of enclosure to infant size as the infant grows. Given the flexibility of the device which permits "L" and "W" to vary, it is useful to express the cavity size as a total linear internal perimeter. Generally when the closures are adjusted to minimize the perimeter, the perimeter most preferably is less than about 40 inches. When the closures are adjusted to maximize the perimeter, the maximum perimeter most preferably is about 55 inches. For smaller infants padding (linen) can be added to the interior of ring to customize size.

The absence of a bottom in the device allows it to be kept clean and in use longer. Also it allows for quick removal for emergency and routine care. It also facilitates the size adjustment described above.

Other embodiments are within the following claims.

I claim:

1. An infant-care device, the device comprising a toroidal perimeter wall defining a continuous central cavity which is open at the top and bottom and sized and shaped to enclose and support the infant in side-lying position, the wall comprising, a) a head-support portion sized to support the infant's head and neck;

b) a foot-brace portion spaced from the head-support portion; and c) a back-support portion connecting the foot-brace portion and the head-support portion, the back-support portion being curved to support the infant's spine, the back-support portion also being sized to maintain a spacing between the head-support portion and the foot-brace portion less than the infant's length, whereby the side-lying infant's feet are supported by the foot-brace portion with hips and knees partially flexed, with spine and neck curved, and with head supported by the head-support portion, said wall comprising at least one closure element, whereby opening said element facilitates removal of the device from around the infant.

2. The device of claim 1 in which the foot-brace portion of the wall is higher than the head-support portion of the wall.

3. The device of claim 1 in which the head-support portion of the wall is removable, the wall comprising at least one closure attaching the head-support portion of the wall to the back-support portion of the wall.

4. The device of claim 3 in which the closure comprises an adjustment member for changing the spacing between the head-support portion and the foot-brace portion.

5. The device of claim 1 in which the internal perimeter of the device is less than 55 inches.

6. The device of claim 1 in which the wall is less than about 7 inches tall.

7. The device of claim 1 in which the wall is insufficiently tall and rigid to support a sitting infant.

* * * * *